United States Patent [19]

Laughlin et al.

[11] 4,358,138

[45] Nov. 9, 1982

[54] SKI POLE WITH FOOT REST AND SKI LIFT CHAIR ENGAGING MEANS

[75] Inventors: James L. Laughlin, 229 Dibblee La., Eugene, Oreg. 97404; Richard F. Hansen, Eugene, Oreg.

[73] Assignee: James L. Laughlin, Eugene, Oreg.

[21] Appl. No.: 212,342

[22] Filed: Dec. 3, 1980

[51] Int. Cl.[3] ..... A63C 11/22

[52] U.S. Cl. ..... 280/819; 135/66; 280/813; 297/438

[58] Field of Search ..... 280/816, 819, 812, 813, 280/809, 820; 135/65, 66; 104/173 ST; 105/329 SC; 297/439, 438, 423; 182/189, 228

[56] References Cited

U.S. PATENT DOCUMENTS

| | | | |
|---|---|---|---|
| 506,255 | 10/1893 | Reutter | 248/155.2 |
| 1,624,591 | 4/1927 | Fleming | 135/66 X |
| 2,445,344 | 7/1948 | Wachtel | 280/812 |
| 2,800,164 | 7/1957 | Chambers | 248/156 X |
| 3,179,436 | 4/1965 | Choy | 280/812 |
| 3,350,111 | 10/1967 | Sahlein et al. | 280/813 |
| 4,013,318 | 3/1977 | Piper | 297/438 |
| 4,130,294 | 12/1978 | Walker | 280/812 |
| 4,299,409 | 11/1981 | Gedicks | 280/819 |

FOREIGN PATENT DOCUMENTS

| | | | |
|---|---|---|---|
| 2104014 | 8/1972 | Fed. Rep. of Germany | 280/813 |
| 2355748 | 5/1975 | Fed. Rep. of Germany | 280/813 |
| 381285 | 10/1932 | United Kingdom | 135/66 |

*Primary Examiner*—Joseph F. Peters, Jr.
*Assistant Examiner*—Milton L. Smith
*Attorney, Agent, or Firm*—Herman J. Hohauser

[57] ABSTRACT

A ski pole in which the elongated shaft is provided with a mounting device for mounting the ski-pole to the seat of a ski-lift and a foot support device extending from the shaft for supporting the feet of a skier when the ski pole is mounted to the ski-lift seat. The mounting device and foot support device have a stored position on the pole and may be a unitary part of the pole or detachably mounted thereto.

12 Claims, 12 Drawing Figures

FIG.4A
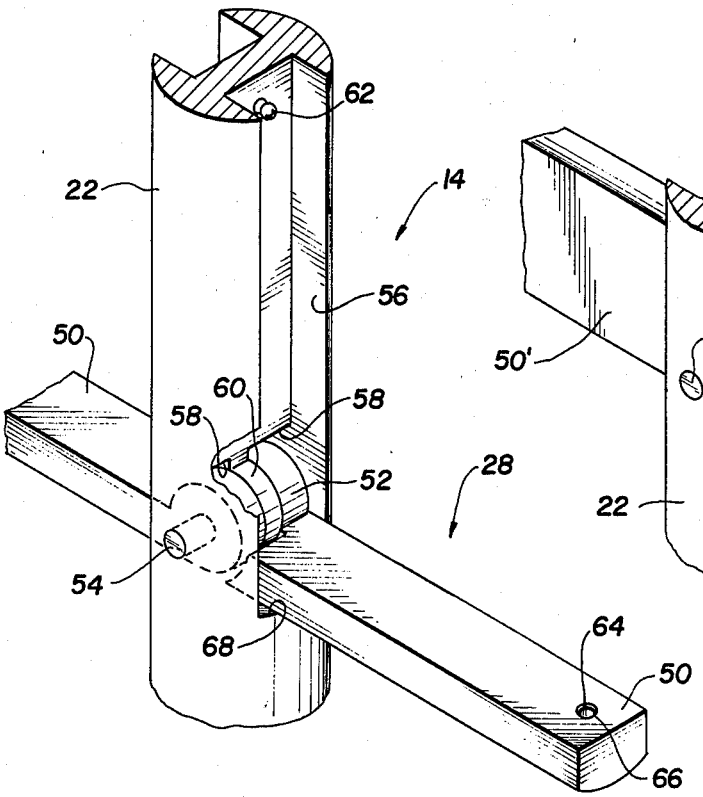
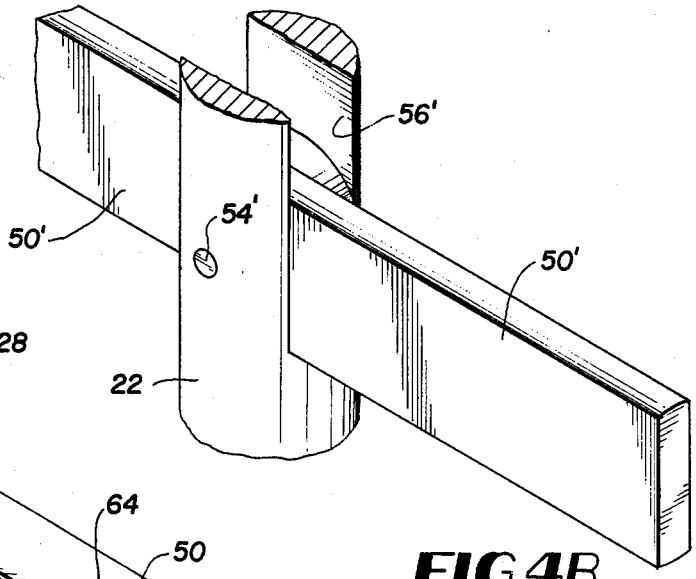
FIG.4B
FIG.5
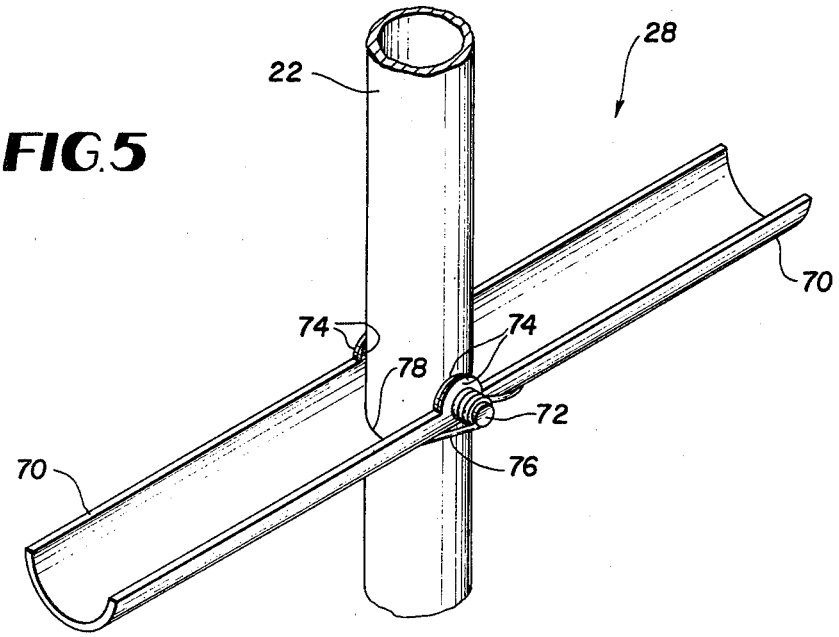

SKI POLE WITH FOOT REST AND SKI LIFT CHAIR ENGAGING MEANS

BACKGROUND OF THE INVENTION

The present invention relates generally to the field of skiing and more particularly to the provisions of a novel ski-pole that can be used as a foot rest for skiers during the time the skier is riding on a ski-lift.

The sport of skiing has reached an ever increasing peak of popularity both in the United States and other countries. Ski slopes are for the most part very crowded especially in the periods of ideal skiing weather conditions. Thus, long periods of standing and waiting occur before one is able to board the ski-lift. Once on the ski-lift, the skier endures a long slow ride to the starting point of the ski-run. As a practical matter, in a given day of skiing, far more time is spent waiting for and riding the ski-lift than is actually spent skiing.

Many ski-lifts consists of a bench-like seat upon which the skier sits. Presently, the great majority of ski-lift seats are not provided with foot rests and as a result during the long ride up the mountain the legs of the skier are left dangling in mid-air. As is well known to skiers, the foot gear including ski boots and attachments are very heavy and cumbersome and thus foot and leg fatigue results from the extended period of the skier's legs dangling in mid-air. Alleviation of this problem has yet to be achieved.

SUMMARY OF THE INVENTION

An object of this invention is to overcome the problem of foot and leg fatigue caused by the combination of heavy foot gear and the lack of foot rests on ski-lifts in a most economical and convenient manner.

Another object of this invention is to provide a ski pole that has included thereon a foot support.

A further object of this invention is to provide a ski pole that has included thereon a foot support and seat mounting means.

A still further object of this invention is to provide a ski pole having a structure that can be easily and temporarily converted into a foot rest having seat mounting means.

According to the invention there is provided a device having the appearance of and serving as a conventional ski pole that can be converted into a foot rest with seat mounting means for use by a skier during the time spent on a ski-lift.

These and other objects of the invention are obtained by providing a ski pole having a mounting device extending from one end of the ski pole shaft for removably mounting the ski pole to the seat of a ski lift and a foot support device extending adjacent the other end of the ski pole for supporting the feet of the skier when the ski pole is mounted to the seat of a ski-lift. The mounting device and foot support device have an extended use position and also a stored position such that the ski pole can be used for skiing without interference from the mounting or foot support devices. The mounting device and foot support device may be a unitary part of the ski pole received in recesses in the ski pole when in the stored position. Alternatively the mounting device and foot support device may be attached to the exterior of the pole wherein the stored position is adjacent the exterior of the pole or removably mounted to the pole. Means may be provided to lock the mounting device and foot support device in its stored and/or extended positions. The mounting device includes at least an arm and preferably a perpendicularly extending flange to engage the top and back of the ski-lift seat respectively. The arm may be rigidly extending from the pole or adjustably attached thereto by a belt. The foot support device preferably includes a pair of oppositely extending arms.

Other objects, advantages, and novel features of the present invention will become apparent from the following detailed description of the invention when considered in conjunction with the accompanying drawings.

BRIEF DESCRIPTION OF THE DRAWINGS

FIG. 4A is a partial view of the foot support device of FIG. 1 in the extended position.

FIG. 4B is a modification of the foot support device of FIG. 4A.

FIG. 5 is a perspective view of another embodiment of a foot support device incorporating the principles of the present invention.

DESCRIPTION OF THE PREFERRED EMBODIMENTS

Figure 1:
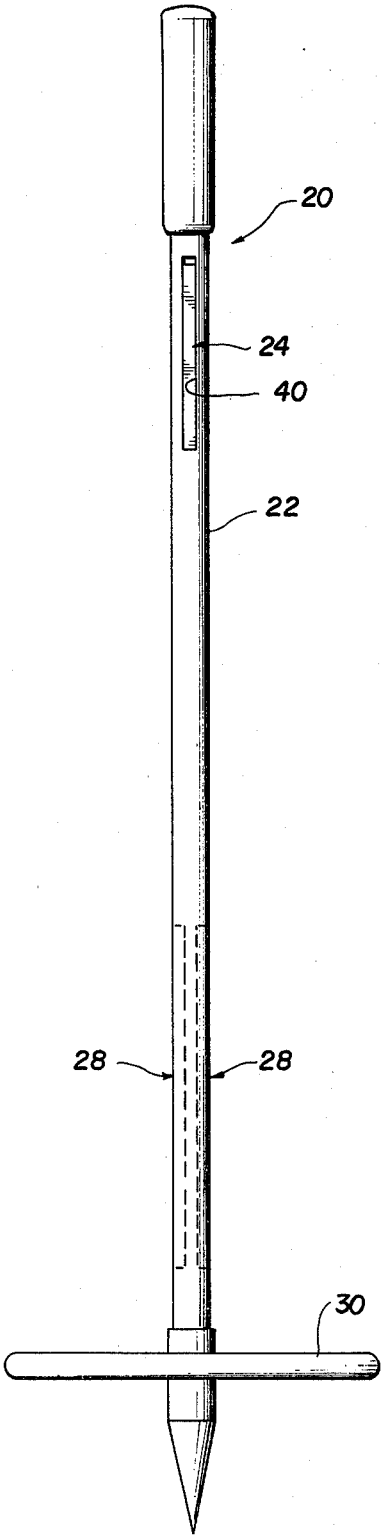
FIG. 1 is a front view of a ski pole incorporating the principles of the present invention with the devices in the stored position.
Figure 3:
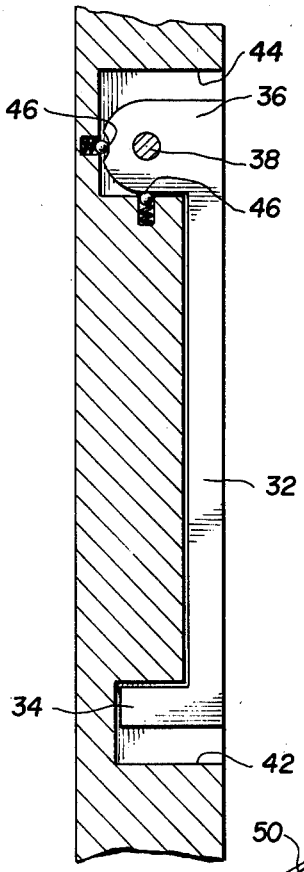
FIG. 3 is a partial cross-sectional view of the mounting device of FIG. 1 in the stored position.

A first embodiment of the present invention is illustrated in FIGS. 1–4 as a ski pole and foot rest 20 including a pole 22 having a chair mounting device 24, foot supports 28 and snow pad 30. The mounting device 24 includes an arm 32 having a flange 34 extending substantially perpendicular therefrom at one end and a truncated cylindrical portion 36 at the other end pivotally connected by pin 38 to the pole section 22. In the stored position illustrated in FIG. 1, the mounting device 24 is concealed in recess 40 which recess includes wells 42 and 44 to receive flange portion 34 and truncated cylindrical portion 36, respectively. Also provided in the surface of well 44 are a pair of detents 46 including a spring and ball. A spherical recess 48 in the exterior surface of truncated cyclindrical portion 36 cooperates with the detents 46 to lock the mounting device 24 in the stored position illustrated in FIGS. 1 and 3 or in the extended position illustrated in FIG. 2. It should be noted that one of the detents 46 may be deleted and a second recess 48 provided on the external surface of the truncated cyclindrical portion 36 of the mounting means 24 to define the other detented position, or in the alternative, no locking position need be provided for the extended position.

The foot support device 28 illustrated in detail in FIG. 4 includes a pair of arm portions 50 each having a cylindrical hinge section 52 at one end thereof pivotally mounted by pin 54 to the pole 22. Each arm 50 is received in a recess 56 of the pole 22 which includes a pair of wells 58 separated by a portion 60. The cylindrical hinge section 52 extends less than half-way across the width of the arm portion 50. Pole portion 60 separates the cylindrical hinge portions 58 of each of the arm portions 50 from each other. Also provided in recess 56 is a ball type catch device 62 which cooperates with a resilient element 64 in opening 66 of the arm 50 to retain it in the stored position illustrated in FIG. 1. In the extended position illustrated in FIGS. 2 and 4, the arm 50 rests against the lower surface 68 of recess 56. The arms 50 of the foot rest 28 extend substantially perpendicular from the pole 22 as illustrated in FIGS. 2 and 4.

An alternative modification of foot support device 28 illustrated in FIG. 4B includes a pair of arm portions 50', each having one end thereof pivotally mounted by pin 54' to the pole 22. Each arm 50' is received in recess 56' of the pole 22 such that in the extended position illustrated in FIG. 2, the bottom edges of arms 50' rest against the lower surface of recess 56'. The arms 50' may be pivoted to the stored position and are retained in that position by friction. Arms 50' are of such a width that when in the stored position, the edges, which may be of arcuate shape, thereof line up and are flush with the outer surface of the pole 22.

This modification results in the arms 50' providing additional support for ski pole 22 as compared with the embodiment of FIG. 4A, wherein arms 50 extend into the recess 56 so that one edge is flush with the outer surface of ski pole 22.

As can be noted from FIGS. 1–4, the external surface of the arm 32 of the mounting device and the arms 50 of the foot support device are curved so as to mate with the curvature of the pole 22 when these devices are in their stored position. Small recesses may be provided in the extended end of arms 32 and 50 to allow gripping them when in the stored position to pivot them to their extended position.

Figure 2:
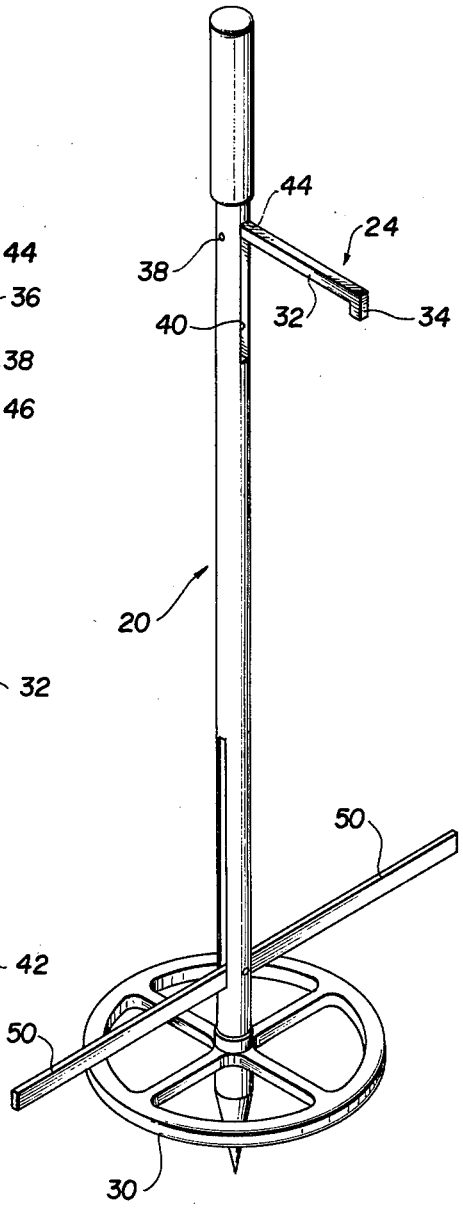
FIG. 2 is a perspective view of the ski pole of FIG. 1 with the devices in the extended position.

The ski pole and foot rest of FIGS. 1–4 will normally have the arm 34 of the mounting device 24 and the arm 50 of the foot support 28 in their stored position illustrated in FIG. 1. Thus the ski pole can be used for skiing without interference from the mounting device and the foot support device. Once the skier has mounted a ski-lift, the skier will rotate arm 32 of the mounting device 24 and arms 50 of the foot support 28 from their stored to their extended positions. Arm 32 is then placed on the seat with flange 34 engaging the rear edge of the seat. The skier can then place his feet on the extended arms 50 of the foot support 28. As the skier reaches the beginning of the ski trail and is about to dismount the ski-lift, the ski pole is removed from the seat and the arms 32 and 50 are rotated back to and locked in their stored positions.

Although flange 34 is preferred, it may be eliminated and either the mounting device 24 may be held in place on the chair by the skier sitting on arm 32, or an orifice may be placed on a shortened arm 32 through which a seat attachment means or the like may be connected as explained in detail below. Since most of the currently manufactured ski poles are tapered metal tubing, portions of the pole in which are stored the mounting device 24 and the foot supports 28 should be solid sections. The recesses and wells can be machined into these solid portions or the solid portions may be cast with the appropriate openings. The remainder of the pole may be the standard metal tubing. Obviously other materials may be used to form the pole 22.

Another embodiment illustrating the unitary construction of the combined ski pole and foot rest is illustrated in FIG. 5. The foot rest 28 includes a pair of semicylindrical arms 70 pivotally mounted at 72 to the pole 22 through ears 74. A coil spring 76 is provided about pin 72 to bias the arms 70 to an upright stored position about pole 22. The weight of the skier's feet will be sufficient to retain the arms 70 in their extended position. An arcuate cutout 78 is provided on the arms 70 to accommodate the external surface of pole 22 in the extended position of the arms 70. Thus the pole 22 in cooperation with cutout 78 provides a stop or lock for the extended position of the arms 70. If desired, a resilient band may be slid onto the pole 22 and about the arms 70 to retain them in their stored position encompassing the pole 22. It should be noted that the foot support 28 of FIG. 5 may be provided as an add-on to existing poles requiring only the drilling of a hole into the pole structure to receive the pin 72.

Figure 6:
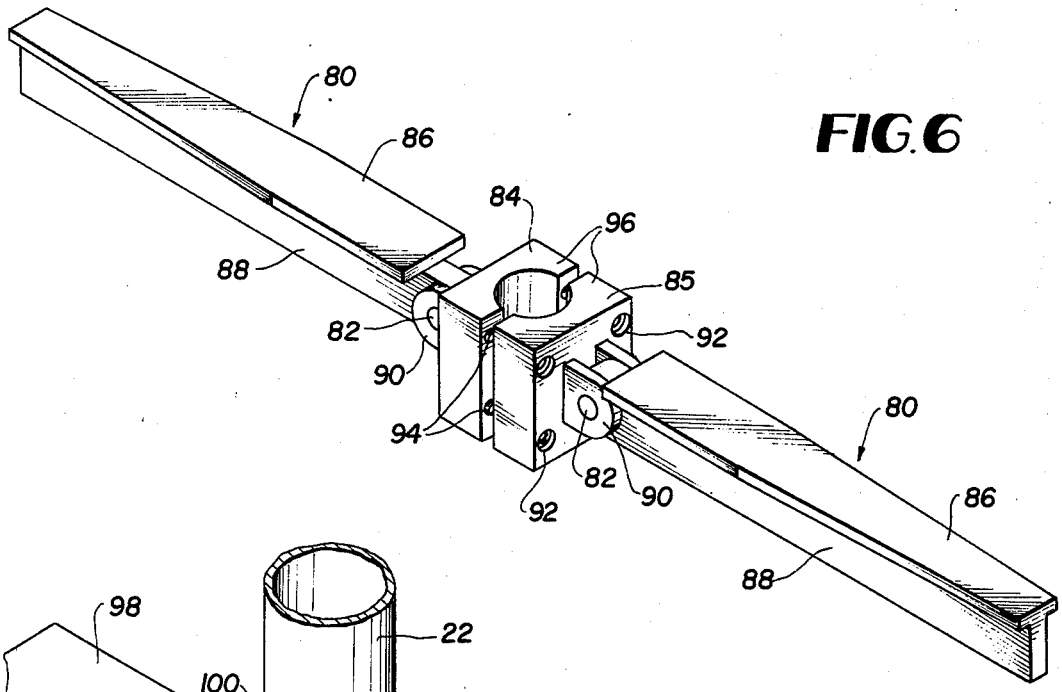
FIG. 6 is a perspective view of even a further embodiment of a foot support device incorporating the principles of the present invention.

An embodiment of another foot rest which may be added to existing poles is illustrated in FIG. 6 as including a foot support arm 80 pivotally mounted by pin 82 to clamp jaws 84, 85. The arm 80 includes a plate 86 having a perpendicularly extended flange 88. The clamp jaws 84, 85 include a pair of perpendicularly extended opposed walls 90. One end of flange 88 is received between the parallel walls 90 and is pivotally connected by pin 82 extending between the walls and through the flange 88. As in the embodiment of FIG. 5, a spring may be provided about pin 82 to bias the arms 80 to their upright stored position. The plate 86 is dimensioned such that the bottom edge will rest on the top edge of clamp jaws 84, 85 in its upright stored position. The end of flange 88 adjacent to the clamp jaws 84, 85 is generally flat and acts as a stop in the extended position illustrated in FIG. 6. Also if it is desired, the detents of FIG. 3 may be provided to lock the arms 80 in their stored or extended position. Recessed apertures 92 are provided in the outer surface of one of the clamp jaw 85 and threaded apertures are provided on the inner face of the opposite clamp jaw 84. The inner faces of both clamp jaws 84, 85 are cut out at 96 to accommodate the external surface of the ski pole. The pair of jaws 84, 85 are positioned about the exterior of a ski pole and fasteners (for example screws) are inserted through openings 92 and rotated so as to move the clamp jaws 84 and 85 towards each other. Thus the foot rest of FIG. 6 is mounted on a standard ski pole and can become a unitary part thereof. If the pole should be damaged or break, the foot support of FIG. 6 may be removed by removing the fasteners.

Figure 7:
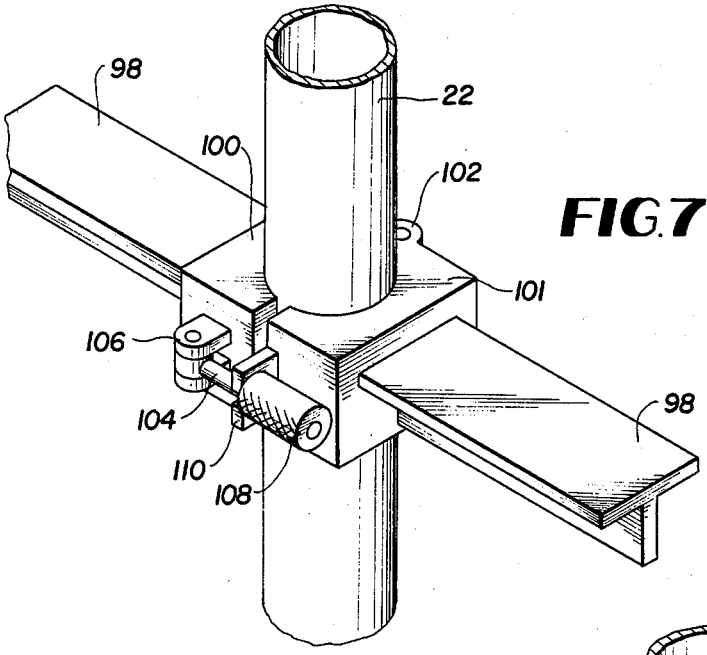
FIG. 7 is a perspective view of still another foot support device incorporating the principles of the present invention.

Another embodiment of a foot rest which is readably detached from the ski pole is illustrated in FIG. 7 and includes a pair of foot supports 98 each having a generally "T" shaped cross-section. Each foot support 98 is mounted to and extends from respective clamp jaws 100 and 101. Hinge 102 pivotally joins clamp jaws 100 and 101 as shown. A shaft section 104 is pivotally connected at one end 106 to clamp jaw 100 and includes a knurled knob 108 threadably mounted thereto at the other end. The clamp jaw 101 has an extending plate 110 with a center recess (unnumbered). To mount the foot rest of the FIG. 7, the clamp jaws 100 and 101 are positioned about the ski pole 22 and the shaft 104 is positioned to lie in the unnumbered center recess of plate 110. The knurled knob 108 can be tightened to draw the clamp jaws 100 and 101 to the position shown in FIG. 7. Although the foot rests 98 are each shown as a unitary piece extending from respective clamp jaws 100 and 101 each may be pivotally mounted as shown in the embodiment of FIG. 6. Further, the knurled knob 108 may be a wing nut or other functional equivalent.

Figure 8:
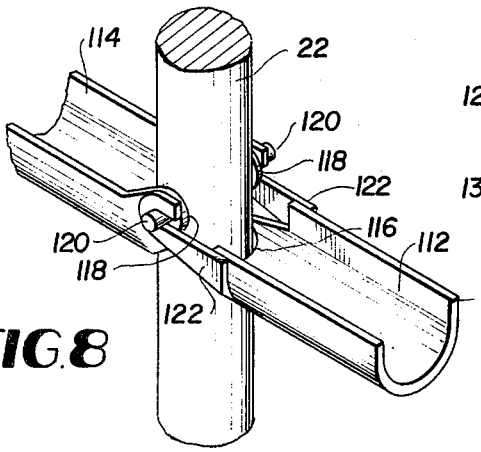
FIG. 8 is a perspective view of still even a further foot support device incorporating the principles of the present invention.
Figure 9:
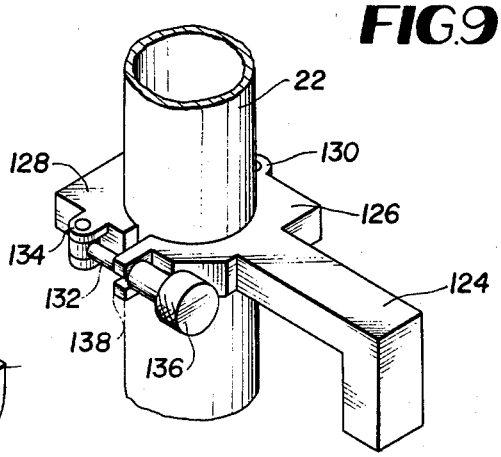
FIG. 9 is a perspective view of another embodiment of a mounting device incorporating the principles of the present invention.

In addition to the foot support being removably attached as illustrated in FIGS. 6, 7 and 8, the mounting device may also be removably attached as illustrated in FIG. 9. An arm 124 of the mounting device extends from a clamp jaw 126 which is pivotally connected to the second clamp jaw 128 at hinge 130. A shaft 132 is pivotally connected at 134 to jaw 128 at one end and has a knurled knob 136 threadably received on its other end. The clamp jaw 126 includes a plate 138 with a recess therein to receive the shaft 132. This is equivalent to the operation of the clamp jaw of FIG. 7 for the foot support device. It should be noted that the mounting device 124 may be detachably mounted to the pole 22 using the clamping device illustrated in FIG. 6 for the foot support.

Figure 10:
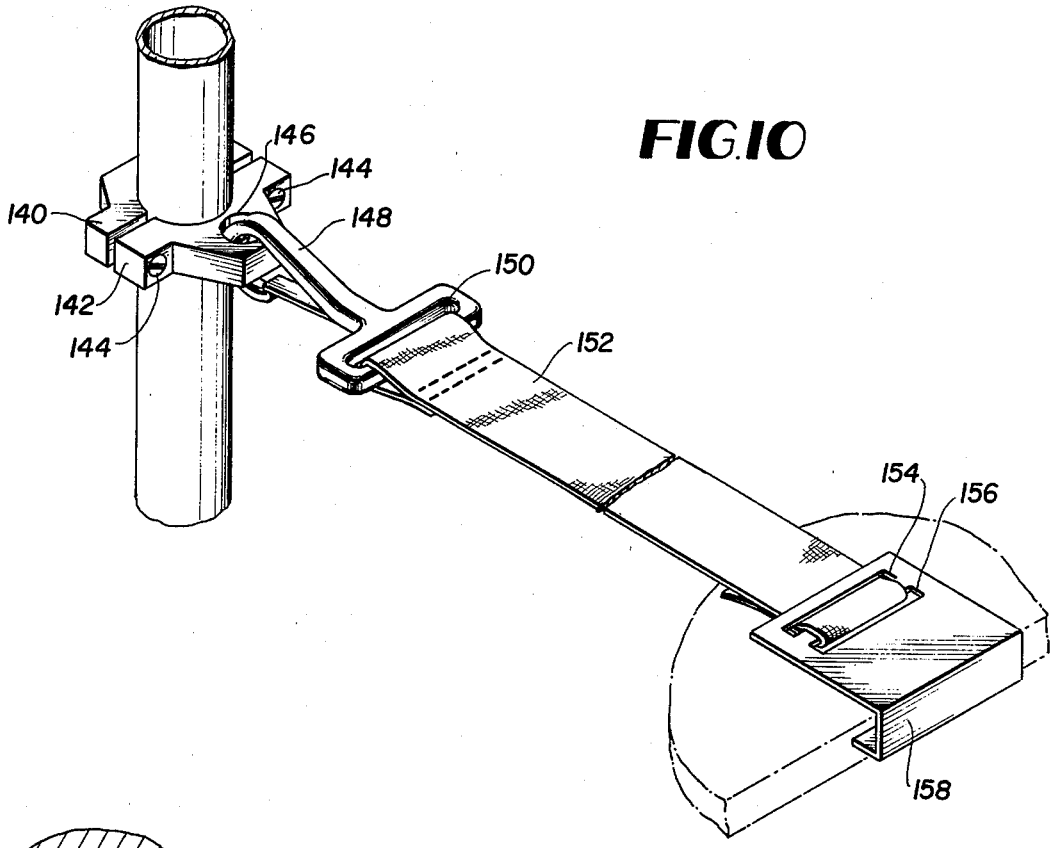
FIG. 10 is a perspective view of even a further mounting device incorporating the principles of the present invention.

Another detachable mounting device is illustrated in FIG. 10 and includes a pair of clamp jaws 140 and 142 encompassing the pole and being secured thereto by a pair of screws 144 traversing clamp 142 and being threadably received in clamp 140. An orifice 146 in the clamp jaw 142 receives a snap hook 148. The base of snap hook 148 includes an opening 150 which receives a belt 152 which traverses the opening 150 and is secured back onto itself by, for example, stitching. The other end of belt 152 is received in a pair of openings 154 and 156 of a hook 158. The base of the hook 158 is received on the rear edge of the seat which is illustrated in phantom. The free end of the belt 152 may be adjusted to varying lengths of the belt to accommodate various width seats. When the mounting device of FIG. 10 is not in use, snap hook 148 is disconnected from orifice 146 and may be stored in the pocket of the jacket of the skier leaving the clamp jaws 140 and 142 on the pole 2 and thus will not hinder the use of the ski pole during normal skiing. Obviously if desired, the clamps 140 and 142 may be jointed using a hinge and rotable lock shaft as illustrated in FIG. 9.

Figure 11:
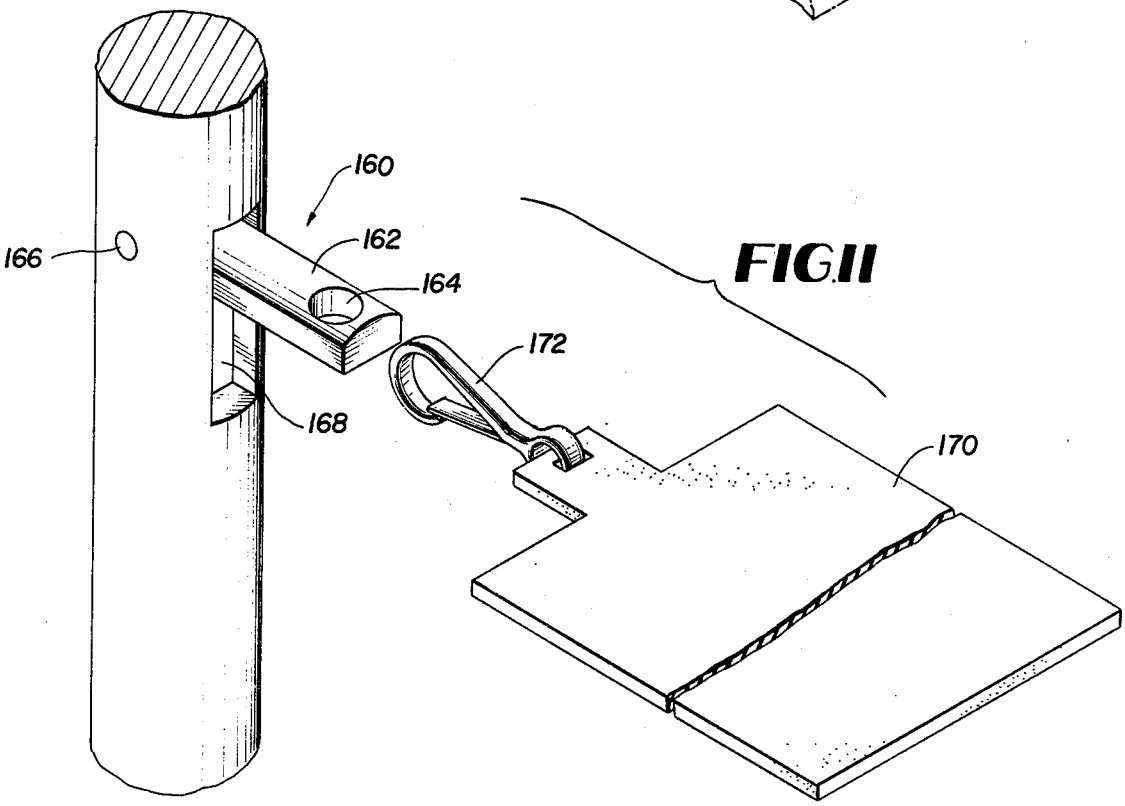
FIG. 11 is a perspective view of still another embodiment of a mounting device incorporating the principles of the present invention.

Another detachable mounting 160 is illustrated in FIG. 11 and includes arm 162 having orifice 164 at an end thereof with its other end being pivotally connected by pin 166 to the pole 22. In the stored position, arm 162 is concealed in recess 168 with a curved outer surface that is flush with the outer surface of the pole 22. In its extended position arm 162 is maintained perpendicular to pole 22.

Seat pad 170, which may be fabricated from any flexible rubber-like material, is removeably attached via snap hook 172 to orifice 164 of arm 162. It is obvious that seat pad 170 may be attached to arm 162 by any suitable means including the strap of the embodiment illustrated in FIG. 10. In practice, the skier before sitting on the ski-lift seat places seat pad 170 upon the ski-lift seat. The weight of the skier is sufficient to maintain the ski-pole in a mounted condition vis-a-vis the ski-lift seat. As soon as the skier is ready to depart the ski-lift, the seat pad 170 may be unhooked from arm 162 and folded to be held in an appropriate place by the skier.

From the preceding description of the preferred embodiments, it is evident that the objects of the invention are attained in that a ski pole is provided which is attachable to a ski-lift seat and provides support for the feet of the skier. Although the invention has been described and illustrated in detail, it is to be clearly understood that the same is by way of example and illustration only and it is not to be taken by way of limitation. The clamping structure for removably attaching either the mounting device or the foot support device may include structures other than those illustrated in the present disclosure. Also, the ski pole 22 is illustrated as a straight pole and the present invention may be used with other shaped ski poles. The spirit and scope of the invention are to be limited only by the terms of the appended claims.

We claim:

1. A ski pole comprising:

an elongated shaft;

first means for removably mounting said ski pole on the seat of a ski-lift; and second means for providing a foot support when said first means is mounted to the seat of a ski-lift wherein said first means is unitary with said elongated shaft, and has a first stored position in which said ski pole can be used for skiing without interference from said first means and a second position for mounting to the seat of a ski-lift, said second means is unitary with said elongated shaft and has a first stored position in which said ski pole can be used for skiing without interference from said second means and a second extended position in which the second means extends perpendicular to said ski pole, and said first and second means are positioned in recesses in said elongated shaft and flush with the exterior of said elongated shaft when in said first stored position.

2. The ski pole as defined in claim 1 including first locking means for retaining said first means in said first stored position and second locking means for retaining said second means in said first stored position.

3. The ski pole as defined in claim 2 wherein said first and second locking means include spring biased detents.

4. A ski pole comprising:

an elongated shaft;

first means for removably mounting said ski pole on the seat of a ski-lift; and second means for providing a foot support when said first means is mounted to the seat of a ski-lift, wherein said first means includes detachable means positioned on the top surface of the seat of the ski lift so that the weight of the skier is sufficient to maintain said first means in a secure mounted condition upon said ski-lift seat.

5. The ski pole defined in claim 4 wherein said detachable means is a seat cushion.

6. A ski pole comprising:

an elongated shaft;

first means for removably mounting said ski pole on the seat of a ski-lift; and second means for providing a foot support when said first means is mounted to the seat of a ski-lift, wherein said second means includes a pair of arms extending in opposite directions from said elongated shaft, said pair of arms are attached at one end and pivot about a common post which traverses said elongated shaft, and wherein said pair of arms are attached to each other interior said elongated shaft.

7. A ski pole comprising:

an elongated shaft;

first means for removably mounting said ski pole on the seat of a ski-lift; and second means for providing a foot support when said first means is mounted to the seat of a ski-lift, wherein said second means includes a pair of arms extending in opposite directions from said elongated shaft and wherein said pair of arms each extend from one of a pair of clamping jaws, said clamping jaws removably mounting said arms to said elongated shaft.

8. A ski pole comprising:

an elongated shaft;

first means for removably mounting said ski pole on the seat of a ski-lift; and second means for providing a foot support when said first means is mounted to the seat of a ski-lift, wherein said second means includes a pair of arms extending in opposite directions from said elongated shaft and wherein said pair of arms are interlocked at one end to pivot relative to each other, said arms at said one end terminate in an arcuate edge similar to the surface of said elongated shaft, said interlocked pair of arms slide freely along said elongated shaft when unloaded and grip said shaft when loaded to provide a foot support.

9. A detachably mounted foot rest in combination with a ski pole including means for mounting said foot rest onto a standard ski pole said means having two portions, each said portion having an arcuate generally semi-circular shaped concave wall for mounting directly to an arcuate shaped convex surface of a ski pole and an opposite wall having support structure means for supporting a pivotable foot rest element said portions further having attachment means connected therewith for removably attaching each with the other and removably positioning its respective pivotable foot rest element in various positions relative to a standard ski pole said foot rest elements being generally parallel to each other and said ski pole when in a first position and forming a generally straight line perpendicular to said ski pole when in a second position.

10. The detachably mounted foot rest of claim 9 wherein each of said support structure means includes hinge receiving means for pivotally mounting said foot rest element and means for maintaining said foot rest elements perpendicular to said ski pole when being used as a foot support.

11. The detachably mounted foot rest of claim 10 wherein said foot rest elements have a generally "T" shaped cross-section.

12. The detachably mounted foot rest of claim 9 wherein said foot rest elements have a generally "T" shaped cross-section.

* * * * *